US010167864B2

(12) United States Patent
Ohgane et al.

(10) Patent No.: US 10,167,864 B2
(45) Date of Patent: Jan. 1, 2019

(54) FUEL PUMP

(71) Applicant: KEIHIN CORPORATION, Shinjuku-ku, Tokyo (JP)

(72) Inventors: Yuya Ohgane, Shioya-gun (JP); Ryuji Aoki, Shioya-gun (JP)

(73) Assignee: KEIHIN CORPORATION, Tokyo (JP)

( * ) Notice: Subject to any disclaimer, the term of this patent is extended or adjusted under 35 U.S.C. 154(b) by 0 days.

(21) Appl. No.: 15/717,247

(22) Filed: Sep. 27, 2017

(65) Prior Publication Data

US 2018/0087502 A1 Mar. 29, 2018

(30) Foreign Application Priority Data

Sep. 29, 2016 (JP) ..... 2016-190504

(51) Int. Cl.

| | |
|---|---|
| ***F02B 53/10*** | (2006.01) |
| ***F02M 59/02*** | (2006.01) |
| ***F04B 53/10*** | (2006.01) |
| ***F02M 63/00*** | (2006.01) |
| ***F02M 59/36*** | (2006.01) |
| ***F02M 59/34*** | (2006.01) |
| ***F02M 59/44*** | (2006.01) |

(52) U.S. Cl.

CPC ..... *F04B 53/1087* (2013.01); *F02M 59/025* (2013.01); *F02M 59/027* (2013.01); *F02M 59/34* (2013.01); *F02M 59/366* (2013.01); *F02M 59/44* (2013.01); *F02M 63/0077* (2013.01)

(58) Field of Classification Search

CPC ..... F02B 53/1087; F02M 59/025; F02M 59/027; F02M 59/34; F02M 59/366; F02M 59/44; F02M 63/0077

USPC ..... 123/495

See application file for complete search history.

(56) References Cited

U.S. PATENT DOCUMENTS

| | | | | |
|---|---|---|---|---|
| 9,803,635 | B2 * | 10/2017 | Kato | F04B 53/1085 |
| 2012/0090708 | A1 * | 4/2012 | Usui | F02M 63/0017 137/565.16 |
| 2012/0288389 | A1 * | 11/2012 | Kuroyanagi | F02M 63/0077 417/559 |

FOREIGN PATENT DOCUMENTS

| | | | |
|---|---|---|---|
| JP | 2012154297 | A | 8/2012 |

* cited by examiner

*Primary Examiner* — Mahmoud Gimie

(74) *Attorney, Agent, or Firm* — Cantor Colburn LLP

(57) ABSTRACT

A valve seat has a fixing portion fixed to the body, an abutting portion where the suction valve body abuts, and a constricted portion which is provided between the fixing portion and the abutting portion and has rigidity lower than that of the fixing portion and the abutting portion.

7 Claims, 4 Drawing Sheets

FUEL PUMP

CROSS-REFERENCE TO RELATED APPLICATION

The present invention claims priority under 35 U.S.C. § 119 to Japanese Patent Application No. 2016-190504 filed on Sep. 29, 2016, the entire content of which are incorporated herein by reference.

BACKGROUND OF THE INVENTION

The present invention relates to a fuel pump.

Description of Related Art

Field of the Invention

Generally, in a direct injection type engine, pressurized fuel is supplied from a fuel pump such as a plunger pump to an injector which injects fuel. Such a fuel pump includes a valve body and a valve seat disposed in a fuel flow path formed inside the body, and opens and closes the fuel flow path by movement of the valve body. For example, Japanese Unexamined Patent Application, First Publication No. 2012-154297 (hereinafter referred to as Patent Document 1) discloses a configuration which includes a valve seat (valve body) having an opening through which fuel passes, a valve body (suction valve) which opens and closes the opening of the valve seat, and an electromagnetic driving unit which moves the valve body.

SUMMARY OF THE INVENTION

Patent Document 1 does not describe details of the method of fixing the valve seat to the body. However, it is conceivable to press-fit the valve seat into a recess provided in the body or to plastically deform the periphery of the recess of the body to join the valve seat by caulking. However, in the case of press-fitting or joining by caulking, it is conceivable that a large external force acts locally on the valve seat during the fixing operation or after the fixing, and there is a possibility that the valve seat is slightly deformed. When such a valve seat is slightly deformed, the flatness of the abutting surface abutting the valve body is degraded, which leads to degradation of the sealing property. In recent years, in order to improve fuel economy or reduce particulate matter, the pressure of the fuel supplied to the injector has increased. For this reason, improvement in sealing property at the time of closing the fuel passage is required in the fuel pump.

An aspect of the present invention has been made in view of the above-described problems, and an object of the present invention is to improve sealing property at the time of closing a fuel flow path in the fuel pump.

The present invention adopts the following modes as means for solving the above-mentioned problems.

(1) A fuel pump according to one aspect of the present invention includes: a body having a fuel flow path provided therein, a valve seat fixed to the body and disposed at an intermediate part of the fuel flow path, and a valve body capable of abutting the valve seat, wherein the valve seat has a fixing portion fixed to the body; an abutting portion where the valve body abuts; and a constricted portion configured to connect the fixing portion and the abutting portion.

(2) In the aspect (1), both the fixing portion and the abutting portion have a hollow cylindrical shape, an axis of the hollow cylindrical shape of the fixing portion and an axis of the abutting portion are arranged coaxially, a maximum diameter of the fixing portion is larger than a maximum diameter of the abutting portion, at least part of the abutting portion is disposed to be housed inside the fixing portion, the fixing portion and the abutting portion are continuously formed in a cross section of the valve seat cut along a plane including the axis, and the constricted portion may be disposed between the fixing portion and the abutting portion in the cross section.

(3) In the aspect (2), a gap separating the abutting portion from the fixing portion may be provided on an outer side of the hollow cylindrical shape of an abutting surface on which the abutting portion abuts the valve body over the entire circumference.

(4) In the aspect (2) or (3), the fixing portion may be inserted into a hole portion provided in the body in the axial direction, and a plane perpendicular to the axis may be provided on an end surface facing an outer side of the body, among two end surfaces of the fixing portion in the axial direction.

(5) In one of the aspects (1) to (4), the abutting portion may have an opening through which fuel passes, and the fixing portion may be annularly provided on an outer edge of the valve seat when viewed from a flow direction of the fuel in the opening.

(6) In the aspect (5), in the abutting portion, an end surface on a downstream side in the flow direction of the fuel may serve as an abutting surface abutting the valve body, and a part on an upstream side in the flow direction of the fuel may be provided with a penetrating groove penetrating from an inner side to an outer side of the opening when viewed from the flow direction of the fuel in the opening.

(7) In one of the aspects (1) to (6), the fixing portion may be fixed to the body by joining by caulking.

According to the aspect of the present invention, in the valve seat, the constricted portion is provided between a part fixed to the body (a fixing portion) and a part where the valve body abuts (an abutting portion). Therefore, even if a large external force is received from the body side when the valve seat is fixed to the body or after it is fixed, due to elastic deformation or the like of the constricted portion, it is possible to prevent the external force from being transmitted to the abutting portion. Therefore, according to the aspect of the present invention, even when an external force is received from the body side, it is possible to prevent deformation of the abutting portion and to maintain the flatness of the abutting surface abutting the valve body. Therefore, according to the aspect of the present invention, it is possible to improve sealing property at the time of closing the fuel flow path in the fuel pump.

DETAILED DESCRIPTION OF THE INVENTION

Hereinafter, an embodiment of a fuel pump according to the present invention will be described below with reference to the drawings. In the following drawings, in order to set each member to a recognizable size, the scale of each member is appropriately changed. In the following embodiments, an example in which the fuel pump of the present invention is applied to a plunger pump which supplies high-pressure fuel to an injector will be described.

Figure 1:
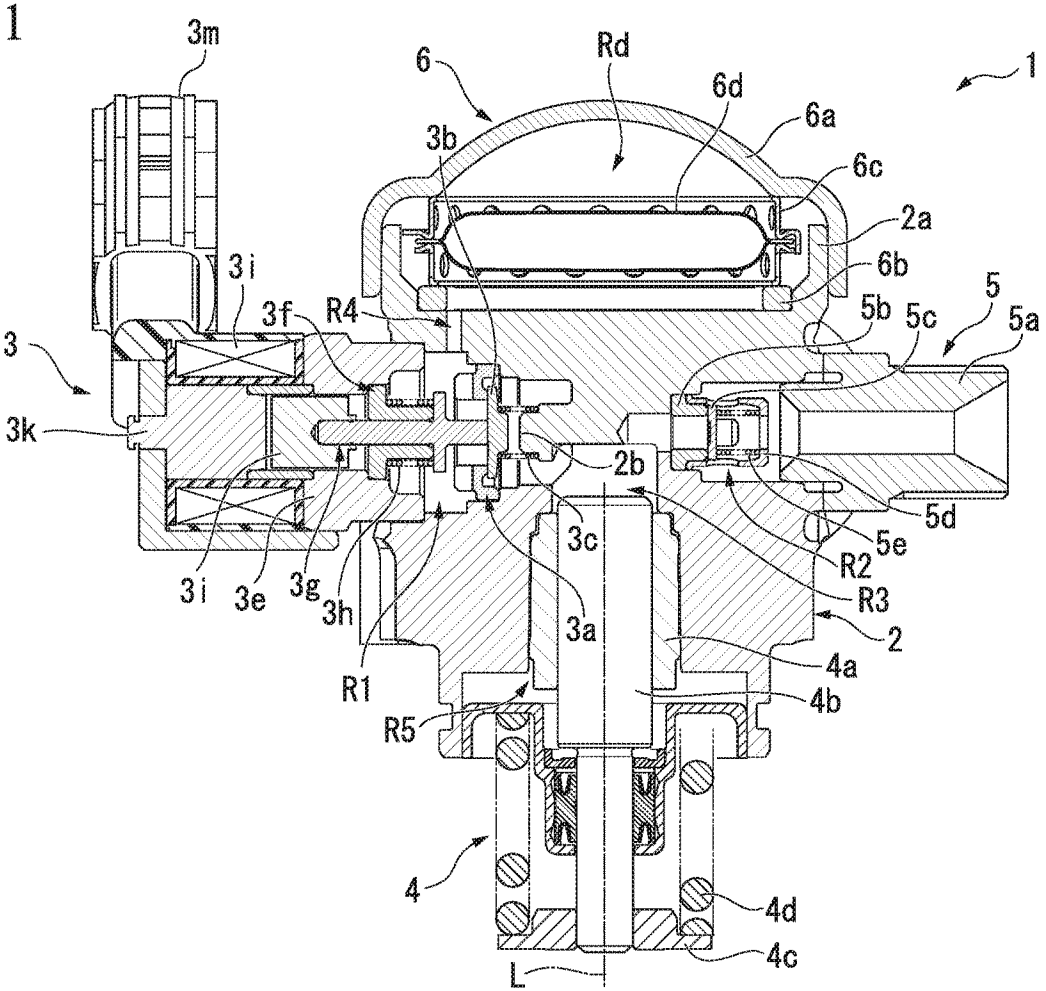
FIG. 1 is a cross-sectional view illustrating a schematic configuration of a plunger pump according to an embodiment of the present invention.

FIG. 1 is a cross-sectional view illustrating a schematic configuration of a plunger pump 1 according to this embodiment. As illustrated in the drawing, a plunger pump 1 of the present embodiment includes a body 2, a suction mechanism 3, a boosting mechanism 4, a discharge mechanism 5, and a damper mechanism 6. In the following description, an axial center of a plunger (boosting plunger 4*b*) which boosts fuel is referred to as a central axis L, a direction orthogonal to the central axis L is referred to as a radial direction of the body, a central axis L side in the radial direction of the body is referred to as an inner side in the radial direction of the body, and a side opposite to the central axis L in the radial direction of the body is referred to as an outer side in the radial direction of the body. Although the installation posture of the plunger pump 1 is not limited, the upper side in FIG. 1 will be referred to as an upper part, and the lower side in FIG. 1 will be referred to as a lower part for convenience of explanation.

The body 2 is a base portion to which the suction mechanism 3, the boosting mechanism 4, the discharge mechanism 5 and the damper mechanism 6 are attached, and a fuel flow path which guides the fuel is formed therein. As illustrated in FIG. 1, in the plunger pump 1 of the present embodiment, as a fuel flow path, a suction flow path R1 to which part of the suction mechanism 3 is fitted, and a discharge flow path R2 to which part of the discharge mechanism 5 is fitted are formed inside the body 2. A pressure chamber R3 which connects the suction flow path R1 and the discharge flow path R2 and pressurizes the fuel is provided inside the body 2. The pressure chamber R3 is disposed at the center of the body 2 in the radial direction of the body.

Further, a cylindrical circumferential wall portion 2*a* projecting upward from the top surface is provided on the top of the body 2. The circumferential wall portion 2*a* forms part of a damper chamber Rd which will be described below. In the body 2, a supply flow path R4 (fuel flow path) penetrating from the bottom portion of the damper chamber Rd (that is, the top surface of the body 2) to the suction flow path R1 is formed. Although not illustrated in FIG. 1, the body 2 also has another fuel flow path such as a flow path which supplies fuel from the outside of the damper chamber Rd to the damper chamber Rd.

Further, the body 2 has a penetrating space R5 which penetrates downward from the pressure chamber R3 and movably houses a boosting plunger 4*b* to be described below. Further, the body 2 has a spring holding portion 2*b* which extends to the suction flow path R1 and is disposed to face a suction valve body 3*b* to be described below from the downstream side (the inner side in the radial direction of the body) in the flow direction of fuel. A suction valve body spring 3*c* to be described below which biases the suction valve body 3*b* is attached to the spring holding portion 2*b*, and the spring holding portion 2*b* also functions as a stopper which regulates the movement of the suction valve body 3*b* from the downstream side (the inner side in the radial direction of the body) in the flow direction of fuel.

Figure 2:
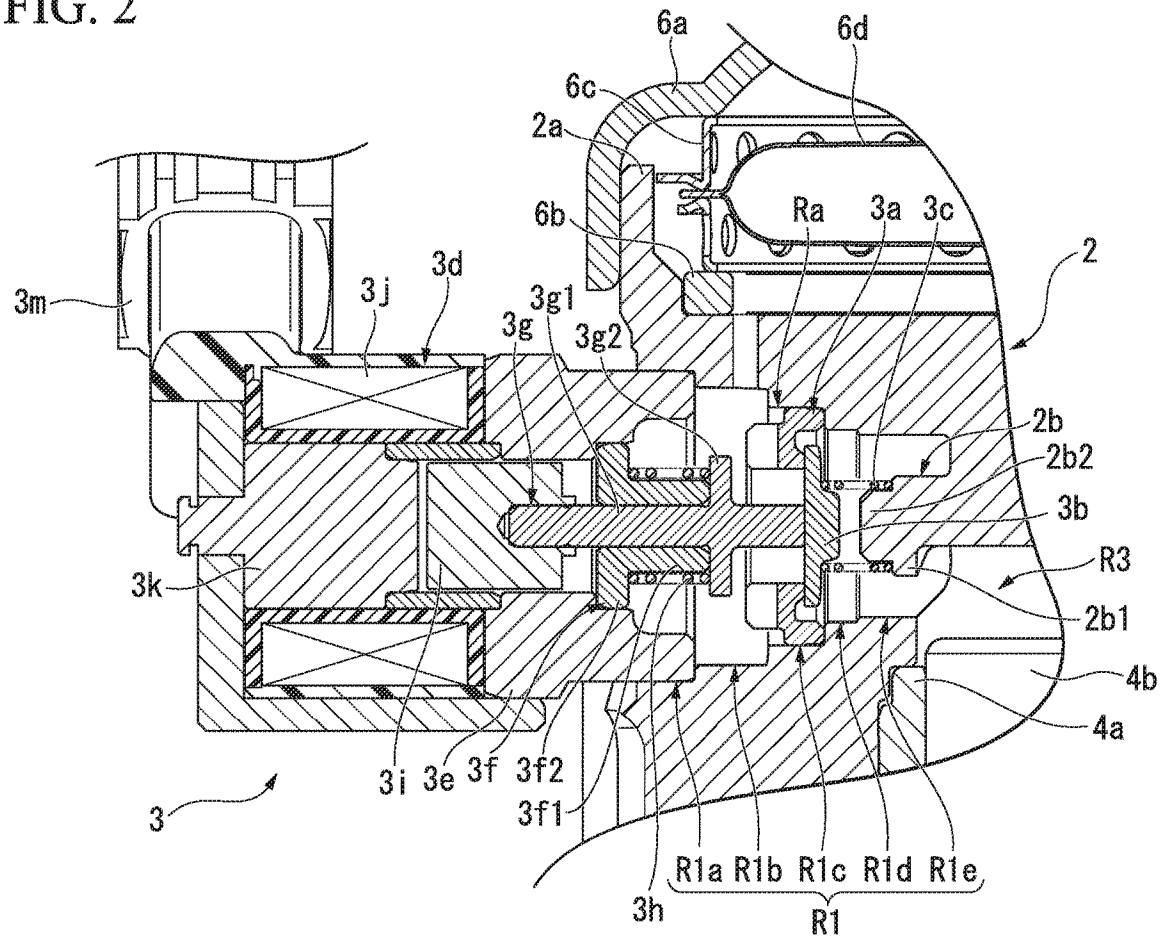
FIG. 2 is an enlarged cross-sectional view including a suction mechanism included in the plunger pump according to the embodiment of the present invention.

FIG. 2 is an enlarged cross-sectional view including part of the suction mechanism 3. As illustrated in FIG. 2, in the present embodiment, the diameter of the suction flow path R1 formed inside the body 2 decreases coaxially and stepwise from an outer wall portion of the body 2 toward the central portion (pressure chamber R3), and has a region R1*a*, a region R1*b*, a region R1*c*, a region R1*d*, and a region R1*e*. The region R1*a* located on the outermost side in the radial direction of the body houses a tip portion of a base portion 3*e* (which will be described below) of the suction mechanism 3. The region R1*b* disposed on the inner side in the radial direction of the body after the region R1*a* has a smaller diameter than the region R1*a* and is connected to the supply flow path R4. The region R1*c* disposed on the inner side in the radial direction of the body after the region R1*b* has a smaller diameter than the region R1*b*, and houses a valve seat 3*a* (which will be described below) of the suction mechanism 3. The region R1*d* disposed on the inner side in the radial direction of the body after the region R1*c* has a smaller diameter than the region R1*c*, and connects the region R1*c* and the region R1*e*. The region R1*e* disposed on the inner side in the radial direction of the body after the region R1*c* and disposed on the centermost portion side of the body 2 has a smaller diameter than the region R1*d*, and connects the region R1*d* and the pressure chamber R3. In the region R1*d*, the aforementioned spring holding portion 2*b* is disposed.

As illustrated in FIG. 2, the spring holding portion 2*b* has a flange 2*b*1 disposed on the inner side in the radial direction of the body, and a columnar protruding portion 2*b*2 protruding from the flange 2*b*1 outward in the radial direction of the body. In such a spring holding portion 2*b*, the end portion of the suction valve body spring 3*c* is fitted to the columnar protruding portion 2*b*2, and the end surface on the inner side in the radial direction of the body of the suction valve body spring 3*c* abuts the flange 2*b*1. In the spring holding portion 2*b*, the tip surface (the end surface on the outer side in the radial direction of the body) of the columnar protruding portion 2*b*2 is disposed to face the suction valve body 3*b*, and the tip surface of the columnar protruding portion 2*b*2 abuts the suction valve body 3*b* trying to move inward in the radial direction of the body, thereby regulating the movement of the suction valve body 3*b* toward the inside in the radial direction of the body (toward the pressure chamber R3).

Figure 3A:
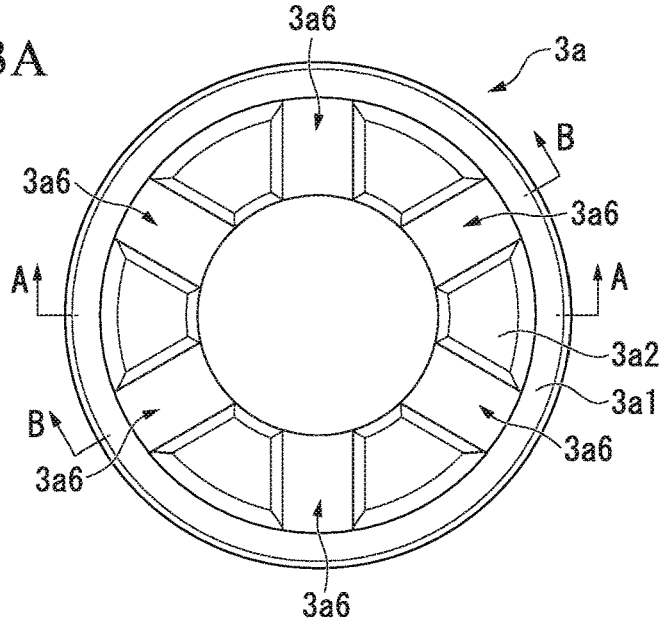
FIG. 3A is an enlarged front view of a valve seat provided in the plunger pump according to the embodiment of the present invention.
Figure 3B:
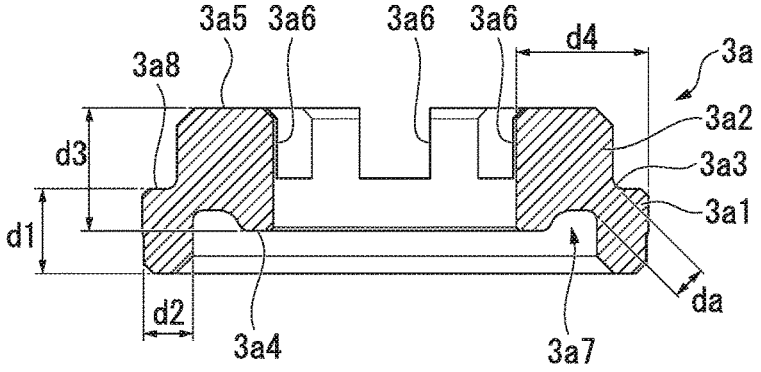
FIG. 3B is a cross-sectional view taken along the line A-A of FIG. 3A.
Figure 3C:
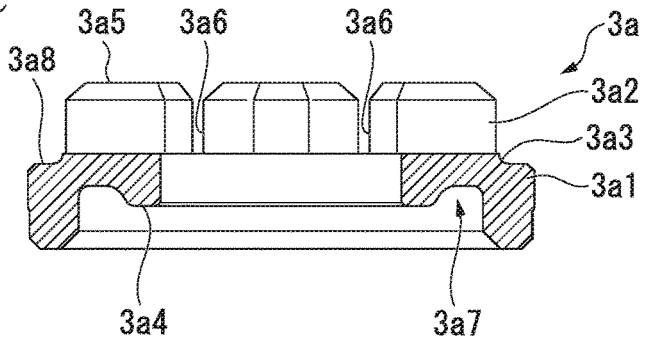
FIG. 3C is a cross-sectional view taken along the line B-B of FIG. 3A.

As illustrated in FIG. 2, the suction mechanism 3 includes a valve seat 3*a*, a suction valve body 3*b* (valve body), a suction valve body spring 3*c*, and a solenoid unit 3*d*. The valve seat 3*a* is disposed in an intermediate part of the suction flow path R1, and has an opening which is opened and closed by the suction valve body 3*b*. FIGS. 3A to 3C are enlarged views of the valve seat 3*a*. FIG. 3A is a front view of the valve seat 3*a* as viewed from the upstream side (the left side in FIG. 2) in the flow direction of fuel. FIG. 3B is a cross-sectional view taken along the line A-A in FIG. 3A. FIG. 3C is a cross-sectional view taken along the line B-B of FIG. 3A. As illustrated in FIGS. 3A to 3C, in the present embodiment, the valve seat 3*a* has a fixing portion 3*a*1, an abutting portion 3*a*2, and a constricted portion 3*a*3.

The fixing portion 3a1 is a part directly fixed to the body 2, and has an annular shape in which an opening is formed at the center. The outer diameter of the fixing portion 3a1 is set to be substantially the same as the inner diameter of the region R1*c* of the suction flow path R1 of the body 2. The fixing portion 3a1 is inserted into the region R1*c* in a state in which the outer circumferential surface abuts the inner wall surface of the region R1*c*. The fixing portion 3a1 is annularly formed at the outer edge of the valve seat 3*a* when viewed from the flow direction of fuel (the flow direction of fuel in the opening of the abutting portion 3a2). The inner diameter of the opening formed in the fixing portion 3a1 is set to be larger than the outer diameter of the suction valve body 3*b*. A depth dimension d1 of the fixing portion 3a1 in the radial direction of the body is set to be smaller than a depth dimension of the region R1*c* of the suction flow path R1 in the radial direction of the body. Such a fixing portion 3a1 is inserted to the innermost side (the inner side in the radial direction of the body) of the region R1*c* of the suction flow path R1, and when part of the body 2 is plastically deformed to bulge to the inner side of the suction flow path R1 in the region (the region Ra illustrated in FIG. 2) on the front side of the fixing portion 3a1, the fixing portion 3a1 is caulked. That is, in the present embodiment, the fixing portion 3a1 is fixed to the body 2 by joining by caulking.

The abutting portion 3a2 is an annular part having an opening formed at the center portion and a smaller diameter than the fixing portion 3a1, and is concentrically connected to the fixing portion 3a1 via the constricted portion 3a3.

The abutting portion 3a2 is disposed further on the outer side in the radial direction of the body than the fixing portion 3a1, and a surface on the inner side in the radial direction of the body is an abutting surface (hereinafter referred to as a valve body abutting surface 3a4) abutting the suction valve body 3*b*.

Further, the outer surface of the abutting portion 3a2 in the radial direction of the body is an abutting surface (hereinafter referred to as the plunger abutting surface 3a5) abutting a plunger flange 3g2 of a suction plunger 3*g*. Further, a plurality of penetrating grooves 3a6 are formed in part of the abutting portion 3a2 on the upstream side of the opening in the flow direction of fuel (a part on the outer side in the radial direction of the body). The penetrating grooves 3a6 are radially formed to penetrate the abutting portion 3a2 from the inside to the outside of the opening of the abutting portion 3a2. The penetrating grooves 3a6 are groove portions opened toward the upstream side in the flow direction of fuel. By forming the penetrating grooves 3a6, the plunger abutting surface 3a5 is omitted in a region in which the penetrating grooves 3a6 are formed.

The constricted portion 3a3 is provided between the fixing portion 3a1 and the abutting portion 3a2 to connect the fixing portion 3a1 and the abutting portion 3a2, and is formed over the entire region in the circumferential direction as viewed from the flow direction of fuel. Since part of the valve seat 3*a* is formed to be partially constricted, the constricted portion 3a3 is a part in which the rigidity of the constricted portion 3a3 is set to be lower than that of the fixing portion 3a1 and the abutting portion 3a2.

As illustrated in FIG. 3B, the thickness dimension da of the thinnest part of the constricted portion 3a3 is set to be smaller than the depth dimension d1 of the fixing portion 3a1, the diameter dimension d2 of the fixing portion 3a1, the depth dimension d3 of the abutting portion 3a2, and the diameter dimension d4 of the abutting portion 3a2. Thus, the rigidity is set to be lower than that of the fixing portion 3a1 and the abutting portion 3a2. That is, if the shortest distance (thickness dimension da) from the space surrounded by the two end surfaces of the valve seat 3*a* in the axial direction and the inner circumferential surface of the valve seat 3*a*, to the space surrounded by the two end surfaces and spreading to the outside of the outer circumferential surface side of the valve seat 3*a* is formed to be smaller than the thickness of the fixing portion 3a1 and the abutting portion 3a2 in the radial direction, and is preferably formed to be smaller than the thickness of the fixing portion 3a1 and the abutting portion 3a2 in the axial direction, the constricted portion 3a3 can be easily formed. Since such a constricted portion 3a3 has lower rigidity than that of the fixing portion 3a1 and the abutting portion 3a2, when caulking the fixing portion 3a1 to the body 2, even if a large external force is received from the body 2 side, the external force is prevented from being transmitted to the abutting portion 3a2 by elastic deformation or the like.

In such a valve seat 3*a*, both the fixing portion 3a1 and the abutting portion 3a2 have a hollow cylindrical shape, and the axis of the fixing portion 3a1 and the axis of the abutting portion 3a2 are disposed to overlap each other. That is, the fixing portion 3a1 and the abutting portion 3a2 are coaxially disposed. Further, the maximum diameter of the fixing portion 3a1 is larger than the maximum diameter of the abutting portion 3a2, and the fixing portion 3a1 and the abutting portion 3a2 are disposed so that at least part of the abutting portion 3a2 is housed inside the fixing portion 3a1. Further, in the valve seat 3*a*, the fixing portion 3a1 and the abutting portion 3a2 are continuously formed via the constricted portion 3a3 in a cross section cut along a plane including the axes of the fixing portion 3a1 and the abutting portion 3a2. That is, the constricted portion 3a3 is disposed between the fixing portion 3a1 and the abutting portion 3a2 in the cross section.

In the valve seat 3*a*, an annular recess 3a7 is provided outside the valve body abutting surface 3a4 when viewed from the direction along the axis (the radial direction of the body). By the recess 3a7, between the abutting portion 3a2 and the fixing portion 3a1 on the surface including the valve body abutting surface 3a4, a gap is formed over the entire circumference surrounding the abutting portion 3a2 to separate the abutting portion 3a2 from the fixing portion 3a1.

Further, in the valve seat 3*a*, among the two end surfaces of the fixing portion 3a1 in the axial direction (radial direction of the body), an end surface 3a8 facing the outer side in the radial direction of the body is a plane perpendicular to the axis of the fixing portion 3a1.

Returning to FIG. 2, the suction valve body 3*b* is disposed on the inner side in the radial direction of the valve seat 3*a* and is held to be movable in the radial direction of the body by the suction valve body spring 3*c*. The suction valve body spring 3*c* is held by externally fitting the end portion on the inner side in the radial direction of the body to the spring holding portion 2*b* of the body 2, and the end portion on the outer side in the radial direction of the body is externally fitted to the protruding portion provided at the central portion of the suction valve body 3*b*. The suction valve body spring 3*c* is a compression coil spring which is contractible by differential pressure when the pressure on the upstream side of the suction valve body 3*b* becomes relatively higher than the pressure on the downstream side, and the suction valve body spring 3*c* biases the body 3*b* toward the outer side in the radial direction of the body.

The solenoid unit 3*d* includes a base portion 3*e*, a guide member 3*f*, a suction plunger 3*g*, a suction spring 3*h*, a movable core 3*i*, a coil 3*j*, a fixed core 3*k*, and a connector 3*m*. The base portion 3*e* is fixed to the body 2 and directly or indirectly supports the guide member 3*f*, the suction plunger 3*g*, the suction spring 3*h*, the movable core 3*i*, the coil 3*j*, the fixed core 3*k*, and the connector 3*m*. The base portion 3*e* is formed in a substantially cylindrical shape having a through-hole formed at the central portion thereof, and its tip portion is inserted into the suction flow path R1 of the body 2 from the outer side in the radial direction of the body. Specifically, in the present embodiment, the tip portion of the base portion 3*e* is inserted into the region R1*a* of the suction flow path R1 formed in the body 2.

The guide member 3*f* is a substantially cylindrical component disposed coaxially with the base portion 3*e* and is internally fitted to the through-hole provided in the base portion 3*e*. The guide member 3*f* includes a tubular portion 3*f*1 having a through-hole through which the suction plunger 3*g* is movably inserted in the radial direction of the body, and a guide flange 3*f*2 provided to project from the outer circumferential surface of the tubular portion 3*f*1 and fixed to the base portion 3*e*. The suction plunger 3*g* has a shaft portion 3*g*1 and a plunger flange 3*g*2. The shaft portion 3*g*1 is a rod-like part which is movably inserted into the through-hole of the tubular portion 3*f*1 of the guide member 3*f* and is longer in the radial direction of the body than the guide member 3*f*. An end portion of the shaft portion 3*g*1 on the inner side in the radial direction of the body is positioned further on the inner side in the radial direction of the body than the guide member 3*f*, and the end portion of the shaft portion 3*g*1 on the outer side in the radial direction of the body is positioned further on the outer side in the radial direction of the body than the guide member 3*f*. The plunger flange 3*g*2 is a plate-like part provided to protrude from the outer circumferential surface of the shaft portion 3*g*1 and is disposed further at a position on the inner side in the radial direction of the body than the guide member 3*f*. Such a plunger flange 3*g*2 is movable in the radial direction of the body between the end surface of the guide member 3*f* on the inner side in the radial direction of the body and the end surface of the valve seat 3*a* on the outer side in the radial direction of the body. Further, when the plunger flange 3*g*2 abuts the valve seat 3*a* from the outer side in the radial direction of the body, the suction plunger 3*g* is restricted from moving inward in the radial direction of the body, and when the plunger flange 3*g*2 abuts the guide member 3*f* from the inner side in the radial direction of the body, the suction plunger 3*g* is restricted from moving outward in the radial direction of the body. Further, when the plunger flange 3*g*2 abuts the valve seat 3*a*, since the end surface of the shaft portion 3*g*1 on the inner side in the radial direction of the body abuts the suction valve body 3*b* to separate the suction valve body 3*b* from the valve seat 3*a*, the suction plunger 3*g* can hold the suction valve body 3*b* at the open position.

The suction spring 3*h* is a compression coil spring externally fitted to the tubular portion 3*f*1 of the guide member 3*f*, the end surface on the inner side in the radial direction of the body abuts the guide flange 3*f*2 of the guide member 3*f*, the end surface on the outer side in the radial direction of the body abuts the plunger flange 3*g*2 of the suction plunger 3*g*. The suction spring 3*h* as described above biases the suction plunger 3*g* inward in the radial direction of the body so that the suction valve body 3*b* is located at the open position when the coil 3*j* is not energized.

The movable core 3*i* is fixed to the end portion of the shaft portion 3*g*1 of the suction plunger 3*g* on the outer side in the radial direction of the body. The movable core 3*i* is housed in the through-hole of the base portion 3*e* and is movable in the radial direction of the body. The movable core 3*i* is moved to the outer side in the radial direction of the body by the magnetic field generated by energizing the coil 3*j* and is moved inward in the radial direction of the body by the restoring force of the suction spring 3*h* when energization to the coil 3*j* is stopped. The coil 3*j* has a substantially cylindrical shape with a winding wound around the base portion 3*e* at the substantially same diameter and is connected to an end portion of the base portion 3*e* on the outer side in the radial direction of the body. The coil 3*j* generates a magnetic field by being energized from the outside via the connector 3*m*. The fixed core 3*k* is disposed inside the coil 3*j* to close the opening provided at the center of the coil 3*j* from the outer side in the radial direction of the body. The connector 3*m* is supported by the coil 3*j* and is electrically connected to the coil 3*j*. The connector 3*m* is connected to a power supply device (for example, an in-vehicle battery) installed outside the plunger pump 1 of the present embodiment.

Returning to FIG. 1, the boosting mechanism 4 includes a barrel 4*a*, a boosting plunger 4*b*, a lower flange 4*c*, and a boosting spring 4*d*. The barrel 4*a* is a tubular component which is internally fitted to the penetrating space R5 of the body 2 to guide the upward and downward movement of the boosting plunger 4*b*. The boosting plunger 4*b* is held to be movable upward and downward so that its upper end surface faces the pressure chamber R3 of the body 2. The boosting plunger 4*b* has a lower end surface abutting a cam (not illustrated) via a lifter (not illustrated), and when the cam is rotated by driving of an engine mounted in the vehicle, the boosting plunger 4*b* moves upward and downward in accordance with the rotation of the cam. The lower flange 4*c* is connected to the lower end portion of the boosting plunger 4*b* and protrudes to the outer side in the radial direction of the body from the circumferential surface of the boosting plunger 4*b*. The boosting spring 4*d* is a compression coil spring interposed between the body 2 and the lower flange 4*c*, and biases the boosting plunger 4*b* downward via the lower flange 4*c*. In such a boosting mechanism 4, the boosting plunger 4*b* rises to reduce the volume of the pressure chamber R3, thereby increasing the pressure of the fuel in the pressure chamber R3.

The discharge mechanism 5 includes a discharge nozzle 5*a*, a discharge valve seat 5*b*, a discharge valve body 5*c*, a spring housing portion 5*d*, and a discharge spring 5*e*. The discharge nozzle 5*a* is a substantially cylindrical component fixed to the body 2 so as to be connected to the discharge flow path R2, and discharges the fuel boosted by the plunger pump 1 of the present embodiment to the outside.

The discharge valve seat 5*b* is disposed inside the discharge flow path R2 and closest to the pressure chamber R3 (closer to the inner side in the radial direction of the body) among the components of the discharge mechanism 5. The discharge valve seat 5*b* has an opening which is opened and closed by the discharge valve body 5*c*. The discharge valve body 5*c* is disposed on the outer side of the discharge valve seat 5*b* in the radial direction of the body and is held to be movable in the radial direction of the body by the discharge spring 5*e*. The spring housing portion 5*d* is externally fitted to the discharge valve seat 5*b* to surround the discharge valve body 5*c* and houses the discharge valve body 5*c* and the discharge spring 5*e* therein. The spring housing portion 5*d* is formed in a substantially cylindrical shape having a through-hole provided in a circumferential surface, a bottom surface, or the like, and allows fuel to pass from the inside to the outside. The discharge spring 5*e* is a compression coil spring interposed between the inner wall surface of the spring housing portion 5*d* and the discharge valve body 5*c*, and biases the discharge valve body 5*c* toward the inner side in the radial direction of the body (toward the discharge valve seat 5*b*).

The damper mechanism 6 includes a cover 6*a*, a seat spring 6*b*, a retainer 6*c*, and a pulsation damper 6*d*. The cover 6*a* has a dome shape, and is fixed to the circumferential wall portion 2*a* of the body 2 to form a damper chamber Rd between the cover 6*a* and the body 2. The seat spring 6*b* is placed on the bottom portion (that is, the top surface of the body 2) of the damper chamber Rd. The seat spring 6*b* is disposed below the retainer 6*c* and biases the retainer 6*c* toward the inner wall surface of the cover 6*a*. The retainer 6*c* is a substantially ring-shaped member that holds the pulsation damper 6*d*, and a plurality of through-holes are formed in the circumferential surface. The pulsation damper 6*d* is a member obtained by bonding two diaphragms in the vertical direction so that an internal space is formed and is housed in a region surrounded by the retainer 6*c*. The pulsation damper 6*d* compresses or expands in accordance with the pressure of the damper chamber Rd and absorbs the pressure fluctuation of the damper chamber Rd.

In the plunger pump 1 of the present embodiment having such a configuration, in accordance with the timing at which the boosting plunger 4*b* is lowered and the pressure in the pressure chamber R3 decreases, the energization to the coil 3*j* of the suction mechanism 3 is stopped (or the amount of current for energizing is reduced). As a result, the suction plunger 3*g* is moved inward in the radial direction of the body by the restoring force of the suction spring 3*h*, and a gap is formed between the valve seat 3*a* and the suction valve body 3*b*. When a gap is formed between the valve seat 3*a* and the suction valve body 3*b*, the fuel stored in the damper chamber Rd is supplied to the pressure chamber R3 through the supply flow path R4 and the suction flow path R1. Further, while the pressure chamber R3 is filled with fuel and the boosting of the fuel is started, the suction valve body 3*b* is kept in an open state by the pressure of fuel flowing through the gap between the valve seat 3*a* and the suction valve body 3*b*. Further, in a state in which the energization to the coil 3*j* is stopped and the gap between the valve seat 3*a* and the suction valve body 3*b* is maintained, even if the boosting plunger 4*b* rises and the volume of pressure chamber R3 decreases, since the fuel in the pressure chamber can flow back to the damper chamber Rd through the suction flow path R1, pressurization of the fuel in the pressure chamber R3 is not performed.

Here, in the plunger pump 1 of the present embodiment, when the suction valve body 3*b* abuts the valve body abutting surface 3*a*4 of the valve seat 3*a*, fuel cannot pass through the valve seat 3*a*, and the suction flow path R1 is in a closed state. By pushing the suction valve body 3*b* abutting the valve body abutting surface 3*a*4 inward in the radial direction of the body by the suction plunger 3*g*, the suction flow path R1 is opened. At this time, the suction plunger 3*g* moves until the plunger flange 3*g*2 abuts the plunger abutting surface 3*a*5 of the abutting portion 3*a*2 of the valve seat 3*a* from the outer side in the radial direction of the body. That is, the plunger flange 3*g*2 of the suction plunger 3*g* is restricted from moving inward in the radial direction of the body, by the abutting portion 3*a*2 of the valve seat 3*a*.

When the boosting plunger 4*b* rises and the volume of the pressure chamber R3 decreases, the fuel in the pressure chamber R3 is boosted. When the fuel is boosted, the suction valve body 3*b* is pushed back to the outer side in the radial direction of the body, and the suction valve body 3*b* is in a closed state. Until the suction valve body 3*b* is in a completely closed state, part of the boosted fuel flows back to the damper chamber Rd through the suction flow path R1 and the supply flow path R4. At this time, the pulsation damper 6*d* is compressed, and the pressure fluctuation of the damper chamber Rd is absorbed by the compression.

When the fuel is boosted in the pressure chamber R3, the discharge valve body 5*c* of the discharge mechanism 5 is pressed outward in the radial direction of the body, and a gap is formed between the discharge valve body 5*c* and the discharge valve seat 5*b*. As a result, fuel boosted in the pressure chamber R3 is discharged to the outside of the plunger pump 1 of the present embodiment through the discharge flow path R2 and the discharge nozzle 5*a*.

Subsequently, in the manufacturing process of the plunger pump 1 of the present embodiment, a method of attaching the valve seat 3*a* to the body 2 will be described with reference to FIGS. 4A to 4B.

Figure 4A:
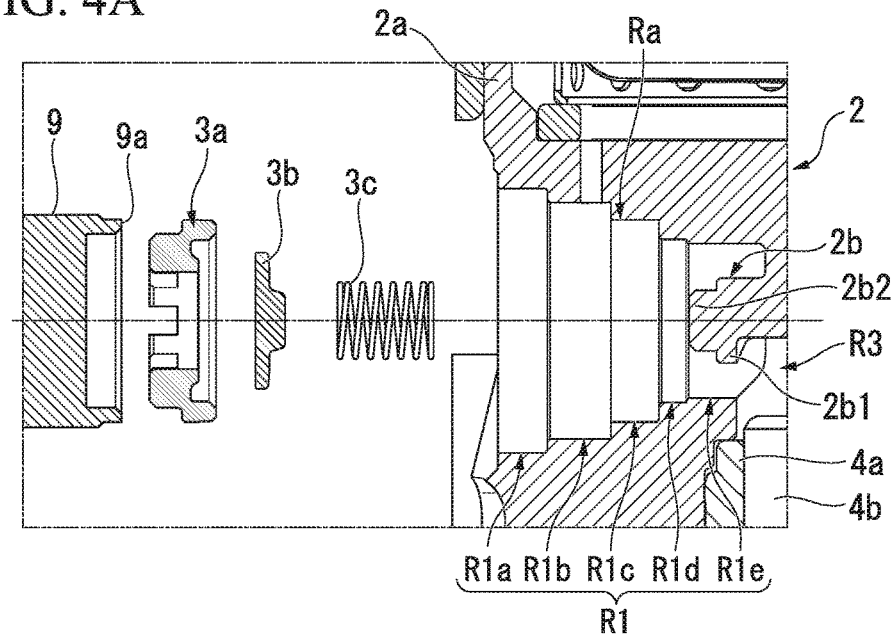
FIG. 4A is a cross-sectional view illustrating part of a manufacturing process of the plunger pump according to the embodiment of the present invention.

First, as illustrated in FIG. 4A, the suction valve body spring 3*c* and the suction valve body 3*b* are first attached to the suction flow path R1, which is a hole portion provided in the body 2, and thereafter, the valve seat 3*a* is inserted. The suction valve body spring 3*c* is fixed to the body 2 by being externally fitted to the spring holding portion 2*b* of the body 2. When the protruding portion protruding inward in the radial direction of the body is internally fitted to the spring holding portion 2*b*, the suction valve body 3*b* is held.

As illustrated in FIG. 4A, the valve seat 3*a* is press-fitted into the suction flow path R1 so that the side of the fixing portion 3*a*1 faces the body 2. The valve seat 3*a* is in a state of being press-fitted to the innermost side of the region R1*c* of the suction flow path R1 and being housed in the region R1*c*. The valve seat 3*a* is press-fitted, as illustrated in FIG. 4A, using a rod-like press-fit tool 9 having an annular press-fit protrusion 9*a* which has an inner diameter larger than the outer diameter of the abutting portion 3*a*2 of the valve seat 3*a* and has an outer diameter smaller than the outer diameter of the fixing portion 3*a*1 of the valve seat 3*a* at the tip. When a press-fit protrusion 9*a* is pressed the end surface 3*a*8 facing the outer side of the fixing portion 3*a*1 in the radial direction of the body and a load is applied to the inner side in the radial direction of the body, the valve seat 3*a* can be press-fitted into the region R1*c* the frictional force which occurs between the outer circumferential surface of the fixing portion 3*a*1 and the inner circumferential surface of the region R1*c*. Subsequently, as illustrated in FIG. 4B, the valve seat 3*a* is caulked to the body 2, using a caulking tool 10 having a diameter larger than the inner diameter of the region R1*c* of the suction flow path R1 and smaller than the inner wall of the region R1*b* of the suction flow path R1.

Figure 4B:
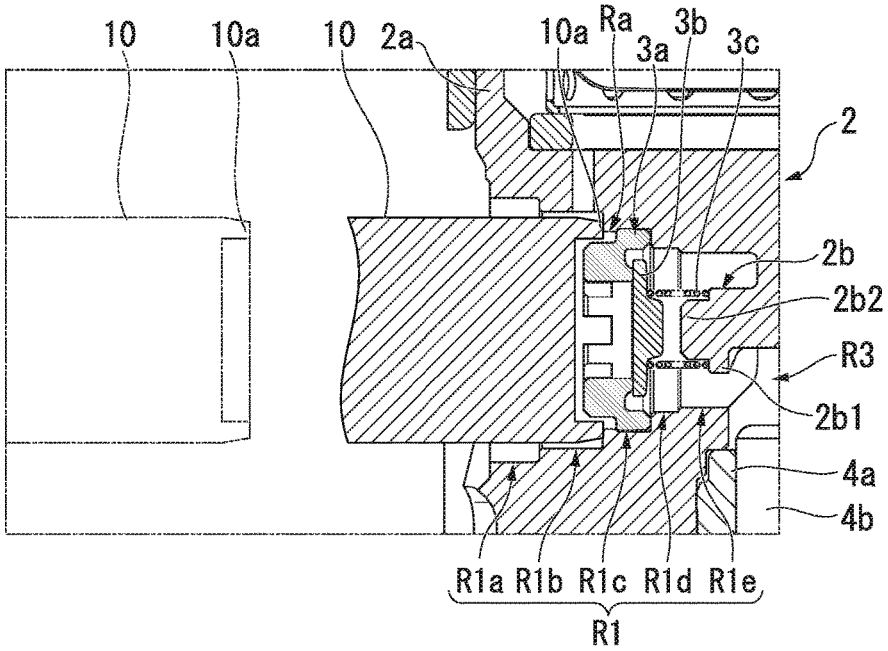
FIG. 4B is a cross-sectional view illustrating part of the manufacturing process of the plunger pump according to the embodiment of the present invention.

As illustrated in FIG. 4B, the caulking tool 10 has a rod shape having an annular protrusion 10*a* at its tip. Such a caulking tool 10 is inserted into the suction flow path R1, into which the valve seat 3*a* is inserted, from the outer side in the radial direction of the body, and the tip of the protrusion 10*a* of the caulking tool 10 is caused to abut a stepped portion of the body 2 which forms the region R1*c*. Thereafter, by further pushing the caulking tool 10, part of the body 2 forming the region R1*c* is plastically deformed to bulge inward in the radial direction of the suction flow path R1, thereby caulking the valve seat 3*a* to the body 2.

Here, in the plunger pump 1 of the present embodiment, the valve seat 3*a* has a constricted portion 3*a*3 with low rigidity, between a part to be fixed to the body 2 (the fixing portion 3*a*1) and a part where the suction valve body 3*b* abuts (the abutting portion 3*a*2). Therefore, when the valve seat 3*a* is fixed to the body 2 or after fixing, even if a large external force is received from the body 2 side, since the constricted portion 3*a*3 having low rigidity is elastically deformed or the like, it is possible to prevent the external force from being transmitted to the abutting portion 3a2. Therefore, according to the plunger pump 1 of the present embodiment, even when an external force is received from the body 2 side, deformation of the abutting portion 3a2 can be prevented, and the flatness of the valve body abutting surface 3a4 can be maintained. Therefore, according to the plunger pump 1 of the present embodiment, it is possible to improve the sealing property when the fuel flow path is closed.

Further, in the plunger pump 1 of the present embodiment, the abutting portion 3a2 has an opening through which fuel passes, and the fixing portion 3a1 is annularly provided on the outer edge of the valve seat 3a when viewed from the flow direction of fuel. Therefore, since the fixing portion 3a1 is located on the outermost side of the valve seat 3a, the fixing portion 3a1 can be easily and reliably made to abut the body 2. Therefore, it is possible to fix the valve seat 3a in a state of being accurately positioned with respect to the body 2.

Further, in the plunger pump 1 of the present embodiment, the end surface of the abutting portion 3a2 on the downstream side in the flow direction of fuel is an abutting surface (valve body abutting surface 3a4) abutting the suction valve body 3b, and a penetrating groove 3a6 penetrating from the inside to the outside of the opening is provided in the part on the upstream side in the flow direction of flow. Therefore, even in a state in which the plunger flange 3g2 of the suction plunger 3g abuts the abutting portion 3a2, the valve seat 3a can allow fuel to pass through the penetrating groove 3a6 as a flow path.

Further, in the plunger pump 1 of the present embodiment, the fixing portion 3a1 of the valve seat 3a is fixed to the body 2 by joining by caulking. Therefore, the valve seat 3a can be fixed to the body 2 even without using fasteners or the like.

In the plunger pump 1 of the present embodiment, both the fixing portion 3a1 and the abutting portion 3a2 of the valve seat 3a have a hollow cylindrical shape, the fixing portion 3a1 and the abutting portion 3a2 are disposed coaxially, the maximum diameter of the fixing portion 3a1 is larger than the maximum diameter of the abutting portion 3a2, and the fixing portion 3a1 and the abutting portion 3a2 are disposed such that at least part of the abutting portion 3a2 is housed inside the fixing portion 3a1. The fixing portion 3a1 and the abutting portion 3a2 are continuously formed via the constricted portion 3a3 in the cross section cut by the plane including the axes of the fixing portion 3a1 and the abutting portion 3a2. By providing the constricted portion 3a3 at such a position, it is possible to easily form the valve seat 3a in a shape having the constricted portion 3a3.

Further, in the plunger pump 1 of the present embodiment, the annular recess 3a7 is provided on the outer side of the valve body abutting surface 3a4 of the valve seat 3a when viewed from the direction along the axis (the radial direction of the body), and a gap is formed between the abutting portion 3a2 and the fixing portion 3a1 over the entire circumference surrounding the abutting portion 3a2. Therefore, it is possible to alleviate the transmission of a force in the radial direction of the valve seat 3a from the fixing portion 3a1 toward the abutting portion 3a2, and it is possible to maintain the flatness of the valve body abutting surface 3a4.

Further, in the plunger pump 1 of the present embodiment, the valve seat 3a is formed such that, among the two end surfaces of the fixing portion 3a1 in the axial direction (in the radial direction of the body), the end surface 3a8 facing the outer side in the radial direction of the body is a plane perpendicular to the axis of the fixing portion 3a1. Therefore, it is possible to accurately receive the force of press-fitting the fixing portion 3a1 into the body in the axial direction (in the radial direction of the body). Therefore, the load at the time of pushing is difficult to be transmitted to the abutting portion 3a2, and deformation of the abutting portion 3a2 can be prevented.

Although the preferred embodiments of the present invention have been described above with reference to the accompanying drawings, it is needless to say that the present invention is not limited to the above-described embodiments. The shapes and combinations of the constituent members illustrated in the above-described embodiments are merely examples, and various modifications can be made based on design requirements or the like without departing from the gist of the present invention.

For example, in the above embodiment, the configuration in which the fixing portion 3a1 is provided on the outer edge of the valve seat 3a has been described. However, the present invention is not limited thereto, and when the shape of the body is different from the above embodiment, it is also possible to adopt a configuration in which the fixing portion 3a1 is not disposed on the outer edge of the valve seat 3a in accordance with the shape of the body.

In the above embodiment, the configuration in which the penetrating groove 3a6 is provided in the abutting portion 3a2 of the valve seat 3a has been described. However, the present invention is not limited thereto, and a through-hole penetrating the abutting portion 3a2 may be formed.

Further, in the above embodiment, the configuration in which the valve seat 3a is press-fitted into the body 2 and then caulked and joined has been described. However, the present invention is not limited thereto, and the valve seat 3a may be held on the body 2 and then caulked and joined in a state in which there is a gap between the outer circumferential surface of the fixing portion 3a1 of the valve seat 3a and the inner circumferential surface of the region R1c of the body 2. Alternatively, the fixing portion 3a1 of the valve seat 3a may be fixed to the body 2 by bolts or the like. Even in this case, it is possible to suppress the external force of the fixing portion 3a1 from being transmitted to the abutting portion 3a2 by the constricted portion 3a3.

In the above embodiment, the example in which the fuel pump of the present invention is applied to the plunger pump 1 for supplying the high-pressure fuel to the injector has been described. However, the present invention is not limited thereto, and the fuel pump of the present invention can also be applied to a fuel pump other than a plunger pump or a fuel pump of a port injection type engine rather than a direct injection type engine.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A fuel pump comprising a body having a fuel flow path provided therein, a valve seat fixed to the body and disposed at an intermediate part of the fuel flow path, and a valve body capable of abutting the valve seat, wherein the valve seat has:

a fixing portion fixed to the body;

an abutting portion where the valve body abuts; and a constricted portion configured to connect the fixing portion and the abutting portion, and wherein both the fixing portion and the abutting portion have a hollow cylindrical shape, an axis of the hollow cylindrical shape of the fixing portion and an axis of the abutting portion are arranged coaxially, a maximum diameter of the fixing portion is larger than a maximum diameter of the abutting portion, at least part of the abutting portion is disposed to be housed inside the fixing portion, the fixing portion and the abutting portion are continuously formed in a cross section of the valve seat cut along a plane including the axis, and the constricted portion is disposed between the fixing portion and the abutting portion in the cross section.

2. The fuel pump according to claim 1, wherein a gap separating the abutting portion from the fixing portion is provided on an outer side of the hollow cylindrical shape of an abutting surface on which the abutting portion abuts the valve body over the entire circumference.

3. The fuel pump according to claim 1, wherein the fixing portion is inserted into a hole portion provided in the body in the axial direction, and a plane perpendicular to the axis is provided on an end surface facing an outer side of the body, among two end surfaces of the fixing portion in the axial direction.

4. A fuel pump comprising a body having a fuel flow path provided therein, a valve seat fixed to the body and disposed at an intermediate part of the fuel flow path, and a valve body capable of abutting the valve seat, wherein the valve seat has:

a fixing portion fixed to the body;

an abutting portion where the valve body abuts; and a constricted portion configured to connect the fixing portion and the abutting portion, and wherein the abutting portion has an opening through which fuel passes, and the fixing portion is annularly provided on an outer edge of the valve seat when viewed from a flow direction of the fuel in the opening.

5. The fuel pump according to claim 4, wherein, in the abutting portion, an end surface on a downstream side in the flow direction of the fuel serves as an abutting surface abutting the valve body, and a part on an upstream side in the flow direction of the fuel is provided with a penetrating groove penetrating from an inner side to an outer side of the opening when viewed from the flow direction of the fuel in the opening.

6. A fuel pump comprising a body having a fuel flow path provided therein, a valve seat fixed to the body and disposed at an intermediate part of the fuel flow path, and a valve body capable of abutting the valve seat, wherein the valve seat has:

a fixing portion fixed to the body;

an abutting portion where the valve body abuts; and a constricted portion configured to connect the fixing portion and the abutting portion, and wherein both the fixing portion and the abutting portion have a hollow cylindrical shape, an axis of the hollow cylindrical shape of the fixing portion and an axis of the abutting portion are arranged coaxially, a maximum diameter of the fixing portion is larger than a maximum diameter of the abutting portion, at least part of the abutting portion is disposed to be housed inside the fixing portion, the fixing portion and the abutting portion are continuously formed in a cross section of the valve seat cut along a plane including the axis, the constricted portion is disposed between the fixing portion and the abutting portion in the cross section, wherein a shortest distance from a space surrounded by two end surfaces of the valve seat in the axial direction and an inner circumferential surface of the valve seat, to a space surrounded by the two end surfaces and spreading to an outside of an outer circumferential surface of the valve seat is formed to be smaller than thicknesses of the fixing portion and the abutting portion in a radial direction, and wherein the constricted portion includes a part where a line indicating the shortest distance of the valve seat passes through.

7. A fuel pump comprising a body having a fuel flow path provided therein, a valve seat fixed to the body and disposed at an intermediate part of the fuel flow path, and a valve body capable of abutting the valve seat, wherein the valve seat has:

a fixing portion fixed to the body;

an abutting portion where the valve body abuts; and a constricted portion configured to connect the fixing portion and the abutting portion, and wherein the abutting portion has an opening through which fuel passes, and the fixing portion is annularly provided on an outer edge of the valve seat when viewed from a flow direction of the fuel in the opening, wherein, in the abutting portion, an end surface on a downstream side in the flow direction of the fuel serves as an abutting surface abutting the valve body, and a part on an upstream side in the flow direction of the fuel is provided with a penetrating groove penetrating from an inner side to an outer side of the opening when viewed from the flow direction of the fuel in the opening, the fuel pump further comprising a plunger capable of abutting the valve body, wherein a plunger flange provided to project from an outer circumferential surface of the plunger is capable of abutting the part on the upstream side in the flow direction of the fuel of the abutting portion.

* * * * *